US012600444B2

(12) United States Patent
Claes et al.

(10) Patent No.: US 12,600,444 B2
(45) Date of Patent: Apr. 14, 2026

(54) METHOD FOR CONTROLLING THE TRIM OF A TRANSPORT SHIP WITHOUT SEAWATER BALLAST

(71) Applicant: Gaztransport Et Technigaz, Saint Remy les Chevreuse (FR)

(72) Inventors: Lorenz Claes, Saint Remy les Chevreuse (FR); Adnan Ezzarhouni, Saint Remy les Chevreuse (FR)

(73) Assignee: Gaztransport Et Technigaz, Saint Remy les Chevreuse (FR)

( * ) Notice: Subject to any disclaimer, the term of this patent is extended or adjusted under 35 U.S.C. 154(b) by 136 days.

(21) Appl. No.: 17/259,148

(22) PCT Filed: Jul. 9, 2019

(86) PCT No.: PCT/FR2019/051710
§ 371 (c)(1),
(2) Date: Feb. 14, 2023

(87) PCT Pub. No.: WO2020/012113
PCT Pub. Date: Jan. 16, 2020

(65) Prior Publication Data

US 2022/0204144 A1 Jun. 30, 2022

(30) Foreign Application Priority Data

Jul. 9, 2018 (FR) ..... 1856298

(51) Int. Cl.
*B63B 39/03* (2006.01)
*B63B 43/04* (2006.01)
*B63B 43/06* (2006.01)

(52) U.S. Cl.
CPC ..... *B63B 39/03* (2013.01); *B63B 43/04* (2013.01); *B63B 43/06* (2013.01); *B63B 2207/02* (2013.01)

(58) Field of Classification Search
CPC ..... B63B 39/00; B63B 39/03; B63B 43/00; B63B 43/06; B63B 43/04; B63B 43/10
(Continued)

(56) References Cited

U.S. PATENT DOCUMENTS

2006/0118019 A1 6/2006 Yang et al.

FOREIGN PATENT DOCUMENTS

CN 2739094 11/2005
CN 2739094 Y 11/2005
(Continued)

OTHER PUBLICATIONS

Anonymous: Oil Tankers—Petroleum Tanker Ship Information:, Feb. 17, 2015, XP055701932.
(Continued)

*Primary Examiner* — Lars A Olson
(74) *Attorney, Agent, or Firm* — Blank Rome LLP

(57) ABSTRACT

The present invention concerns a method for controlling the trim of a transport ship without seawater ballast (1), having a width l considered along a transverse axis (y'y) of the ship (1), said ship (1) having an unladen weight $P_v$ between 20% and 60% inclusive of its total weight $P_T$, allowing for a given maximum load weight capacity $P_{TC}$, in accordance with the formula:

$$P_T=P_v+P_{TC}$$

at least one first and one second closed liquid tank (3' or 3") not communicating with the sea, the total weight $P_{RT}$ of which when entirely filled with a liquid of specific gravity equal to 1 represents between 2% and 8%, preferably between 3% and 6%, of said unladen weight $P_V$, said tanks (3', 3") being in communication via at least one line to transfer liquid from one to the other and being at a distance d from one another, considering the respective geometric center of each of said tanks (3", 3"), at least equal to ½ when
(Continued)

the tanks (3', 3") are positioned facing one another essentially along the transverse axis (y'y): d≥½.

4 Claims, 3 Drawing Sheets

(58) Field of Classification Search
USPC ..... 114/121
See application file for complete search history.

(56) References Cited

FOREIGN PATENT DOCUMENTS

| | | | | | |
|---|---|---|---|---|---|
| CN | 1786550 | A | | 6/2006 | |
| CN | 201932335 | | | 8/2011 | |
| CN | 201932341 | U | | 8/2011 | |
| CN | 201980382 | | | 9/2011 | |
| CN | 203958540 | U | | 11/2014 | |
| CN | 104229092 | A | | 12/2014 | |
| CN | 105836090 | A | | 8/2016 | |
| CN | 107600306 | A | | 1/2018 | |
| FR | 1032510 | | | 7/1953 | |
| FR | 2309393 | | | 11/1976 | |
| GB | 2044201 | | | 10/1980 | |
| GB | 2343434 | | | 5/2000 | |
| GB | 2343434 | A | | 6/2000 | |
| JP | S49-12793 | Y | | 3/1974 | |
| JP | S56-71683 | A | | 6/1981 | |
| JP | H05-67595 | U | | 9/1993 | |
| JP | 2007-525624 | A | | 9/2007 | |
| JP | 2012-187986 | A | | 10/2012 | |
| KR | 10-0834289 | B1 | | 5/2008 | |
| KR | 101334325 | B1 | * | 11/2013 | ..... B63B 43/06 |
| KR | 10-20140046878 | A | | 4/2014 | |
| SU | 1004193 | A1 | | 3/1983 | |
| WO | WO03010044 | A1 | | 2/2003 | |
| WO | WO2012083687 | | | 6/2012 | |
| WO | WO2014/087008 | A1 | | 6/2014 | |
| WO | WO-2018220331 | A1 | * | 12/2018 | ..... F17C 13/004 |

OTHER PUBLICATIONS

International Search Report of PCT/FR2019/051710.
International Preliminary Examination Report of PCT/FR2019/051710.
Chinese Office Action of Application No. 201980046896.8 issued Oct. 12, 2022.
Zhu, Kaiyuan, "A Brief Discussion on the Ballast Water System of Several Ships," *Ships*, Issue 1, pp. 12-15, Feb. 2003.
JP Office Action dated May 23, 2023 issued in JP Appl. No. 2021-500675.
KR Office Action dated Jul. 1, 2023 issued in KR Appl. No. 10-2021-7002803.
EP Office Action issued May 24, 2023 issued in EP Appl. No. 19753151.0.
Chinese Office Action of Application No. 201980046896.8 issued Mar. 21, 2022.

* cited by examiner

METHOD FOR CONTROLLING THE TRIM OF A TRANSPORT SHIP WITHOUT SEAWATER BALLAST

CROSS-REFERENCE TO RELATED APPLICATION

The present application is a U.S. National Stage of International Application No. PCT/FR2019/051710, filed Jul. 9, 2019, which claims priority to French Patent Application No. 1856298, filed Jul. 9, 2018, both of which are incorporated herein by reference in their entirety.

FIELD OF THE INVENTION

The invention has for object a ship without seawater ballast. The present invention more particularly concerns a ship capable of transporting a very large quantity of merchandise, such as a ship with liquified natural gas, hereafter LNG, tanks or a ship with liquified gas (LG), such as for example ethylene, methane, ethane or liquified petroleum gas (LPG), transport tanks, and therefore showing a very significant reduction in its draught when it is sailing unladen, with virtually no load, or with a reduced load, and on the other hand a ship of this kind that, because of the nature of the merchandise that it is specifically likely to transport, systematically effects a return voyage without said merchandise.

PRIOR ART

Throughout the world, a large number of merchant ships use seawater ballast that is filled or partly filled in order to maintain under all circumstances optimum navigability conditions. The main function of this seawater ballast is to lower the ship in the water, in other words to increase its draught or again to raise its waterline (the seawater level reached on the hull of the ship).

Indeed, as a general rule, seawater ballast is necessary to obtain a sufficient draught for complete immersion of the propulsion screw (or propulsion screws) and to prevent the screw from planing. Ordinary cargo ships have a relatively shallow draught when they are not transporting merchandise and are not ballasted. This phenomenon of reduction of the draught (or lowering of the waterline) is all the more marked when the unladen weight of the ship represents a relatively small percentage of its total loading capacity, expressed by weight, that is to say the total weight of the ship when loaded to the maximum of its capacity.

In the context of the present invention, by the expression "unladen weight of a ship" is meant the weight of the ship with no cargo and no equipment other than that necessary for its operation, i.e. with a little fuel. Given the relative weights, it will be considered here that the unladen weight of the ship means that the latter contains only a negligible quantity of fuel.

Without the use of ballast the screw is generally not sufficiently immersed and the draught at the bow of the ship is extremely low because of the weight of the equipment of the ship, essentially situated at the stern thereof. Under these conditions, sailing in a port zone or at the exit of the port and voyage on the high seas are not authorized because safety in relation to the conditions of navigability of the ship is not acceptable.

This is why, in order to satisfy these navigability conditions, a considerable quantity of seawater is transported between different regions of the globe by these merchandise transport ships.

Again, this obligation to use seawater ballast to reestablish satisfactory navigability conditions when the ship is no longer transporting merchandise (the expression "unladen" may be used hereinafter) is particularly pregnant when those ships have a very large loading capacity so that, when unladen, these ships have much too shallow a draught (or much too low a waterline on the hull) given their length, height and width dimensions.

Moreover, for example in the case of a very long methane tanker type ship, the disposition of the elements necessary for navigation such as the navigation tower, the engine or engines and the other elements necessary for the operation of the ship are situated at the stern of the ship and the tanks intended to store the LNG are situated on the bow part of the ship. Consequently, when the LNG storage tanks are empty, an imbalance between the elements necessary to the functioning of the ship and the tanks imparts to the ship an inclined trim such that the bow of the ship is raised relative to the stern. This raised bow can cause a large portion of the bow to emerge from the water, for example a portion of the bow bulb, degrading the stability of the ship and the navigation conditions of the ship, for example during maneuvers to enter into a port.

From a technical point of use, the use of seawater ballast entails very high technological and operational investments. Moreover, the functioning of the ship may be degraded over time because this seawater ballast introduces a considerable quantity of waste eventually forming a layer of sediment at the bottom of the ballast tanks. It should also be noted that this large quantity of ballast considerably slows the speed of the ship, which reduces its capability to remain at sea if the conditions of the latter are bad, in particular because of very severe weather.

Moreover, entry into some port zones imperatively requires the presence of a pilot authorized to effect the approach and mooring maneuvers because they know the safe channel that the ship must follow. These temporary pilots of the ship board by means of a shuttle, a small boat or the like coming to be positioned alongside the ship. Now, if the waterline of a ship without ballast, conventionally having a V-shape lower hull, is too low, the shuttle or the like may be crushed by the flanks of the ship, by these movements in the case of a heavy sea.

From an environmental point of view, the transport of ballast water leads to the transfer of local aquatic organisms and pathogens from one geographical zone to another because at least some of the ballast water is jettisoned in exchange for the loading of the cargo. Because of this, serious ecological problems occur in maritime zones near large ports of some countries. This has recently led to the modification of the international regulations concerning the treatment of water ballast, imposing decontamination and/or sterilization thereof before jettisoning it. Such is equipment becoming obligatory for all ships with seawater ballast.

There are known the documents WO 03010044 and WO 2012083687 that respectively disclose a complex system for seawater management to confer on it a rate of flow between the bow and the stern of the ship in order to obtain the same ballasting conditions with a reduced volume of seawater and a ship without ballast having a V-shaped lower hull instead of a flat bottom. The documents CN 201980382, CN 201932341 and CN 201932335 also disclose a modification of the geometry of the hull and of the interior space of the ship dedicated to the cargo in such a manner as to avoid seawater ballast.

None of these technical embodiments discloses an effective solution to allow or even to improve the navigability of transport ships without ballast when the latter are travelling unladen.

BRIEF DESCRIPTION OF THE INVENTION

The present invention intends to remedy the problems and draw backs of existing ships without seawater ballast by improving, or even merely authorizing, the navigability of these ships in the open sea or on approach to and in port zones. More specifically, but not exclusively, the present invention intends to propose a solution for ships able to transport a particularly large quantity or volume of cargo, such as ships transporting LNG, phenomena of reduction of the draught, of inclination of the trim of the ship or of lowering of the waterline becoming critical for the navigability of those ships.

There has been discovered by the applicant, after various studies and analyses, a technically simple to implement solution enabling unladen navigability to be assured equivalent or quasi-equivalent to that of ships with seawater ballast whilst avoiding or eliminating all the drawbacks inherent to those ballast systems.

Thus the invention concerns a transport ship without seawater ballast having a length L along the longitudinal axis x'x of the ship and a width & along a transverse axis y'y of the ship and including a lower hull a cross section of which takes the form of a trapezium comprising a part forming a flat bottom of the ship from which respectively extend two flanks of identical inclination, said ship having an unladen weight $P_v$ between 20% and 60% inclusive of its total weight $P_T$, allowing for a given maximum load weight $P_{TC}$, according to the formula:

$$P_T=P_v+P_{TC}.$$

Such a lower hull the cross section of which takes the form of a trapezium enables the draught of the ship to be increased relative to other hull section shapes, for example relative to a hull shape of rectangular section such as some methane tankers have.

In accordance with a preferred embodiment of the invention, the ship includes at least one first and one second closed liquid tank, not communicating with the sea, the total weight $P_{RT}$ of which, when entirely filled with a liquid of specific gravity equal to 1, represents between 2% and 8%, preferably between 3% and 6%, of said unladen weight $P_V$, said tanks being in communication via at least one line for the transfer of liquid from one to the other, said tanks including:

- at least two tanks positioned facing one another essentially along the longitudinal axis (x'x) and at a distance d from one another, considering the respective geometric center of each of said tanks (2, 3, 3', 3"), at least equal to L/4: d≥L/4, and/or
- at least two tanks positioned facing one another essentially along the transverse axis (y'y) and at a distance d from one another, considering the respective geometric center of each of said tanks (3', 3"), at least equal to ½: d≥½.

The cross section, in which the lower hull has a trapezium shape, is conventionally situated along the longitudinal axis x'x between 20% and 70% of the length L of said ship considered from the stern of the ship.

By the term "lower hull" is meant the lower part of the ship when the latter is functioning normally (typically at sea), considered from the location where the two lateral walls of the hull, designated hereinabove by the term "flanks", extend in an inclined plane and no longer vertically. In other words, the lower hull is here considered as the lower part of the ship extending, from the flat bottom, as far as the two opposite ends of the two identically inclined flanks: to aid understanding, the appended FIG. 5*a* in particular indicates this lower part of the ship here called the "lower hull" (the part of the ship below the Plimsoll line referenced 20). The Plimsoll line 20 designates the upper limit of the inclined lateral walls and extends parallel to the flat bottom of the ship.

By the expression "liquid of specific gravity equal to 1" is meant water, either pure or slightly charged with minerals, for example, the mass of which is established substantially equal to one (1) kilogram (between 0.95 kg and 1.05 kg) per liter or one (1) metric ton per cubic meter ($m^3$).

Thanks to the invention, there is henceforth available a ship for transporting large quantities of merchandise, typically a ship specifically designed to transport LNG, having improved navigability properties, necessitating less energy expenditure for the same journey (because of a draught lower than unladen conventional ships) and avoiding the additional equipment costs imposed for ships with seawater ballast because of the absence of draw backs of an ecological kind and the necessity to respect local ecosystems.

Moreover, when the present invention is applied to a methane tanker or to a liquified gas transporter, two examples of ships for which the invention is particularly indicated, advantages induced by this solution are possible:

- ease of installation of one or more sumps at the bottom of the storage tanks because of the V-shaped geometry of the lower hull;
- departitioning of the "cofferdam" or "cofferdams", where applicable double hull spaces (not occupied by the ballast water), between two storage tanks because of the absence of seawater ballast generally situated nearby, the ambient air possibly being envisaged as heat-exchange fluid, instead of or in addition to current systems for heating said cofferdam or cofferdams, intended to maintain the steel walls at a relatively high temperature, greater than or close to zero degrees Celsius;
- a reduction of the number of storage tanks and of the associated handling system (reduction of the number of pumps, valves, detection systems, etc.), that is to say of the necessity for compartmenting the ship, because of the improved floatability properties of the ship (and therefore an increased capability of reaching a port in the event of breaches risking it foundering) in the absence of seawater ballast, typically enabling reduction from three (3) or four (4) to only two (2) tanks, or even only one tank. This reduction of the number of tanks improves the overall thermal performance of the transport ship, thanks in particular to the following three points: a significant reduction of the area to be thermally insulated, a significant reduction of the calories needed by the heating system (typically at the level of the cofferdams), and finally the absence of seawater ballast, which leads to a large reduction of the calories penetrating the hull.

Other advantageous features of the invention are specified hereinafter:

- in accordance with one preferred embodiment of the invention, when the tanks are positioned facing one another essentially along the longitudinal axis x'x, one of the tanks is situated in the first third, preferably in the first quarter, at the bow of the ship and the other tank is preferably situated in the last third, preferably in the last quarter, at the stern of the ship;

the ship in accordance with the invention advantageously includes a third tank, situated between a zone comprising between 40% and 60% of the length L of the ship, communication for the transfer of liquid between the first and second tanks preferably being effected via said third tank;

in accordance with a preferred embodiment of the invention, when the tanks are positioned facing one another essentially along the transverse axis y'y, one of the tanks is situated in the first lateral third, preferably in the first lateral quarter, of the ship and the other tank is preferably situated in the last lateral third, preferably in the last lateral quarter, of the ship;

the ship in accordance with the invention advantageously includes a set of valves for managing the arrival, or non-arrival, of liquid and its flow rate in each of the tanks, at least one pump for the transfer of liquid from one of the tanks to another tank and means for introduction of liquid into at least one of the tanks;

in accordance with one possibility offered by the invention, the ship includes at least one mooring tank, independent of the liquid tanks, disposing of at least one communication line (where applicable with seawater) for filling/emptying it, said tank being situated in the first bow third, preferably in the first bow quarter, of the ship:

This mooring tank is used when the ship is docked, in particular to modify or to rectify the trim of the ship when loading/offloading it. This mooring tank is not intended to be filled when the ship is moving or only when it is moving in the port or in the port zone, and so is not similar to seawater ballast.

Said communication line preferably has its outlet orifice situated above the unladen waterline of the ship so that it is very easy to drain that tank.

Moreover, in accordance with a preferred embodiment of the invention, filling is effected via a line or an inlet situated at the level of the upper wall of said mooring tank.

In the context of a methane tanker type ship not transporting any load and having an inclined trim, a mooring tank of this kind is particularly useful since it enables the trim of the ship to be reestablished when the ship enters or sails in the port zone or enters a dry dock for repair or maintenance. Indeed, a mooring tank of this kind enables the trim of the ship to be reestablished and therefore for the waterline to be parallel surface of the water. In particular, in the context of a ship in dry dock, if the ship has an inclined trim upon removal of the water present in the dry dock, the weight of the ship will initially rest entirely on the same part of the hull, in this instance the stern containing the functional equipment of the ship in the context of a methane tanker type ship, which may lead to deterioration of the hull because of the high weight of the ship resting on a localized portion of the hull. On removal of the water present in the dry dock resetting the trim of the ship enables the ship to rest uniformly on the dry dock and therefore to have a balanced distribution on the hull of the ship of the supporting forces, thus preventing deterioration of the hull.

Moreover, a mooring tank of this kind does not generate ecological risks because it is filled and emptied locally, that is to say in the same port zone, to correct the trim of the ship. Thus there is no risk of contamination of the water of a port zone by water coming from another port zone.

the ship in accordance with the invention preferably has an unladen weight $P_v$ between 30% and 50% inclusive of its total weight $P_T$;

the ship in accordance with the invention advantageously includes at least one sealed and insulating tank, said tank including two successive sealing barriers, a primary one in contact with a product contained in the tank and a secondary one disposed between the primary barrier and a support structure, preferably consisting of at least a part of the walls of the ship, these two sealing barriers alternating with two thermally insulating barriers or a single thermally insulating barrier disposed between the primary barrier and the support structure.

Tanks of this type are conventionally designated integrated tanks in the code of the International Maritime Organization (IMO), such as for example MARK III® type tanks.

in accordance with another possibility offered by the invention, the ship includes at least one sealed and insulating tank, said tank including a sealing barrier and a thermally insulating barrier. This type of structure is more particularly illustrated by so-called independent tanks according to the IMO code, such as for example tanks of type C.

with the first two hypotheses, the tank preferably contains liquified natural gas (LNG) or a liquified gas (LG);

at least a part of the space surrounding the tank is advantageously unpartitioned:

By the expression "unpartitioned space" is meant that the volume between two contiguous tanks or between the tank and another part of the ship (these spaces being known to the person skilled in the art as cofferdams) are open, or non-closed, spaces allowing the circulation for example of ambient air from or to said volumes and the adjacent volumes.

when the ship contains no load, the inclination of said flanks is such that the extremities of those flanks are situated at most at a height of 0.8 meter above the water level, preferably at most at a height of 1 meter above the water level (the sea or the ocean here constituting the water level).

The invention also relates to a transport ship without seawater ballast having a length L along the longitudinal axis x'x of the ship and a width & along a transverse axis y'y of the ship and including a lower hull a cross section of which takes the form of a trapezium comprising a part forming a flat bottom of the ship from which respectively extend two flanks of identical inclination, said ship having an unladen weight $P_v$ between 20% and 60% inclusive of its total weight $P_T$, allowing for a given maximum load weight $P_{TC}$, according to the formula:

$$P_T=P_v+P_{TC}.$$

In this embodiment, when the ship does not contain any load and preferably when the liquid in the tanks has been transferred in such a manner as to correct the trim of the ship, the two upper extremities of the flanks are at a height h above the water level of at most one (1) meter, preferably at most one half (0.5) meter.

The invention also provides a transport ship without seawater ballast, the ship having a length L along the longitudinal axis x'x of the ship and a width & along a transverse axis y'y of the ship and including a lower hull a cross section of which takes the form of a trapezium comprising a part forming a flat bottom of the ship from which respectively extend two flanks of identical inclination, said ship having an unladen weight $P_v$ between 20% and 60% inclusive of its total weight $P_T$, allowing for a given maximum load weight $P_{TC}$, according to the formula:

$$P_T=P_v+P_{TC}$$

said ship including at least one mooring tank, the ship further including a line for supplying the mooring tank with liquid and a line for draining the mooring tank, said mooring tank being arranged at the bow of the ship so that transferring liquid into the mooring tank via the supply line enables correction of the trim of the ship.

All of the embodiments or modes or execution described above may be included in this above particular embodiment.

The two flanks advantageously have an inclination angle between 10° and 45° inclusive, preferably between 15° and 35° inclusive.

DESCRIPTION OF THE APPENDED FIGURES

The following description is given by way of nonlimiting illustration only with reference to the appended figures, in which.

Figure 5A:
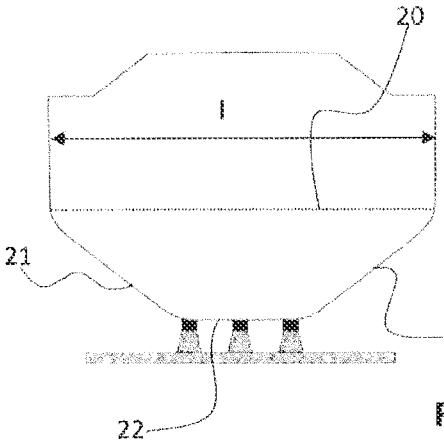
Figure 5B:
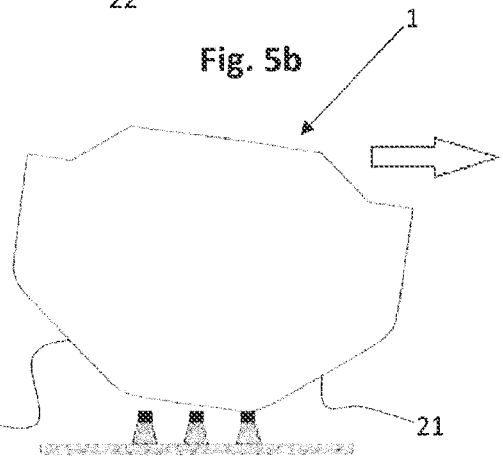
Figure 6:
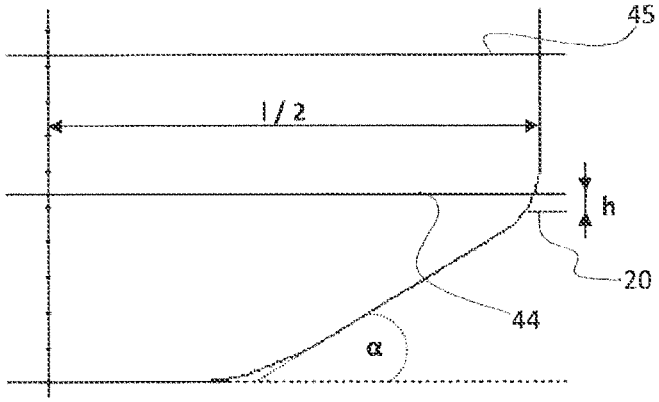

FIGS. 5*a* and 5*b* respective and schematically illustrate a ship in accordance with the invention and that same ship subjected to a high crosswind, this ship being disposed in dry dock:

FIG. 6 is a view in section of a portion of the hull of a ship in accordance with one embodiment of the invention in which are shown the waterlines when the ship contains a partial or complete load and when that same ship is unladen, with no load.

Figure 7:
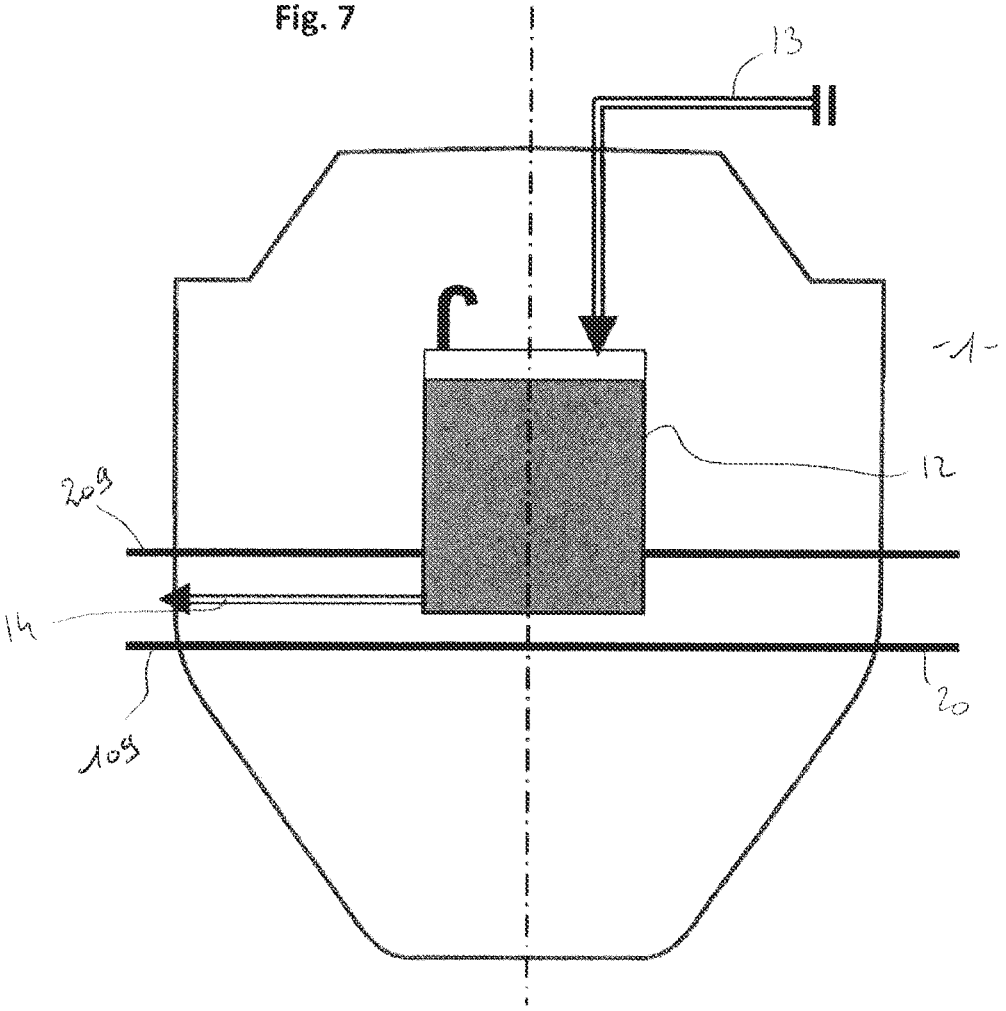

FIG. 7 is a view in section of a ship including a mooring tank.

DETAILED DESCRIPTION OF THE INVENTION

Figure 1:
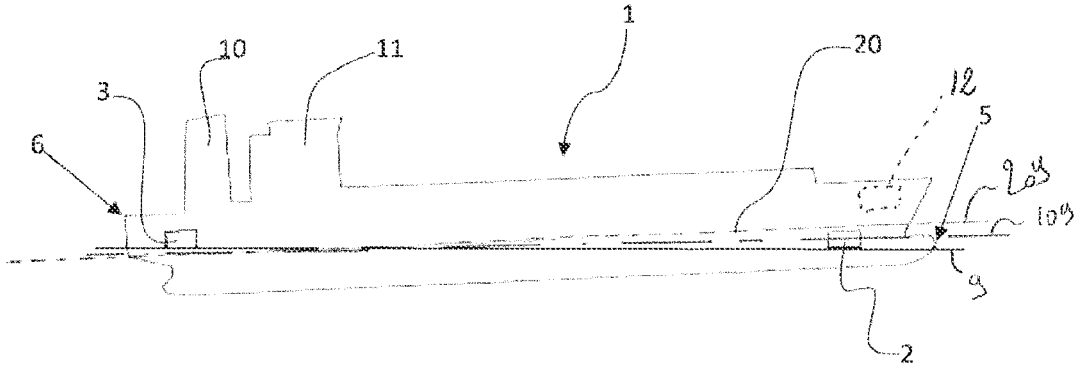
FIG. 1 illustrates, in schematic section, a ship without ballast in accordance with one embodiment of the present invention.

FIG. 1 shows an embodiment of a ship 1 in accordance with the invention and the ship 1 chosen to illustrate the invention is not transporting merchandise/cargo or a relatively small quantity thereof.

In this embodiment, this ship 1 includes two liquid tanks 2, 3, one 2 situated in the front (bow) part and the other 3 situated in the rear (stern) part, these two liquid tanks 2, 3 communicating with one another in such a manner as to allow a transfer of liquid from one to the other. To be more precise, the bow tank 2 is placed in the first bow quarter of the ship 1, with reference to the length L of the ship, from the bow end 5 of the ship 1 to the stern end 6 of the ship 1. In the same manner, in this embodiment, the stern tank 3 is situated in the final stern quarter of the ship 1. It may be envisaged that the bow liquid tank 2 is situated in the first bow part representing the first 12.5% (⅛) of the length L of the ship 1 and/or that the stern liquid tank 3 is situated in the last stern part representing the last 12.5% (⅛) of the length L of the ship 1.

As can be seen in FIG. 1, the ship 1 chosen to illustrate the invention conventionally includes a navigation tower 11, conventionally termed the superstructure, and equipment 10, conventionally termed the smokestack, situated essentially at the stern of the ship 1 so that the ship 1 is inclined toward the stern, along the longitudinal axis x'x, in other words the Plimsoll line 20 of the ship 1 has an inclination relative to the surface of the sea 9, here represented along the longitudinal axis x'x.

This inclination of the ship 1 is particularly important in the case of very long ships 1 intended to transport a large load, the navigation tower 11 and the equipment 10 being situated at the stern of the ship 1 and the bow of the ship 1 being reserved for the storage of the merchandise. For example, in the context of a methane tanker type ship 1, tanks intended to store LNG are disposed over all the length of the ship 1 forward of the superstructure. Accordingly, when the ship is not transporting LNG, the bow of the ship 1 has a weight significantly less than the weight of the stern of the ship 1 so that there is a high inclination of the ship 1 relative to the level of the sea. This inclination may cause a large portion of the bow portion of the hull to emerge and in particular at least a portion of the bow bulb, thus degrading the navigation conditions of the ship.

Figure 2:
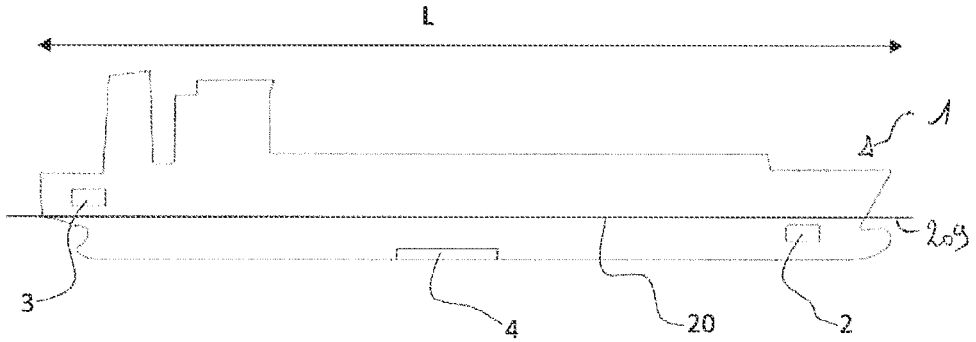
FIG. 2 illustrates, in schematic section, a ship without ballast in accordance with another embodiment of the present invention.

In this example, if the choice is made to send all or virtually all of the liquid into the bow tank 2, then the Plimsoll line 20 of the ship 1 has no or little inclination relative to the surface of the sea, as represented by the waterline 109 in FIG. 1 or by the waterline 209 in FIG. 2. In other words, the transfer of the liquid into the bow tank enables the trim of the ship 1 to be corrected by reducing the inclination of the ship 1 relative to the surface of the sea, typically by reducing the inclination between the Plimsoll line 20 and the waterline 109.

In a complementary manner, the ship 1 may include a mooring tank 12 as sketched in dashed line in FIG. 1. This mooring tank 12 is situated at the bow of the ship 1. A mooring tank of this kind is dedicated to correcting the trim of the ship 1 when unladen, in particular to facilitate maneuvering in a port zone, and to ensure a homogeneous distribution of the weight of the ship when the ship 1 is in dry dock. This mooring tank 12 is filled with liquid in order further to increase the weight of the bow of the ship 1 and thus to correct the trim of the ship 1 by balancing the stern of the ship 1 including the equipment 11 and the superstructure 10 and the empty storage zone situated at the bow of the ship 1. This kind of mooring tank 12 is typically filled with seawater when the ship is not transporting any load and enables a waterline 209 to be obtained that is substantially parallel to the Plimsoll line 20. This kind of mooring tank is preferably independent of the bow tank 2 and the stern tank 3, in other words the liquid used for the functioning of the bow tank 2 and the stern tank 3 does not communicate with the liquid enabling the mooring tank 12 to function.

This mooring tank 12 being limited to use in the port zone, it may be filled with seawater to facilitate maneuvers in the port zone and emptied when the ship 1 has to leave the port zone. This kind of mooring tank 12 dedicated to navigation in a port zone therefore does not represent any risk to the ecosystem because the seawater used to fill the mooring tank 12 is drawn up and then discharged in the same geographical area. Furthermore, when the ship 1 enters dry dock, a Plimsoll line 20 that is substantially horizontal (that is to say parallel to the level of the water in the dry dock) enables good distribution of the weight of the ship 1 over all of the length of the hull when the dry dock is emptied of water to cause the ship 1 to rest on the bottom of the dry dock.

FIG. 2 shows another embodiment of the ship 1. In this case, the ship 1 includes three liquid tanks 2, 3, 4, that is to say the bow liquid tank 2 and the stern liquid tank 3 present in the ship 1 represented in FIG. 1 to which has been added a midships tank 4, that midships tank 4 being in communication with the other two tanks 2, 3 to transfer liquid from one to the other. The midships tank 4 is situated substantially in the middle of the ship 1, along its longitudinal axis x'x, typically in a zone between 30% and 70% inclusive of the length L of the ship 1, considered from the bow end 5 or the stern end 6 of the ship 1 along the longitudinal axis x'x, preferably in a zone between 40% and 60% inclusive of the length L of the ship 1.

In accordance with one possibility offered by the invention, liquid is preferably transferred between the bow tank 2 and the stern tank 3 via this midships tank 4. In accordance with another possibility, liquid is transferred or may be transferred between the bow tank 2 and the stern tank 3 independently of this midships tank 4.

As can be seen in this FIG. 2, the distribution of the liquid between the bow tank 2, the stern tank 3 and the midships tank 4 is such that the Plimsoll line 20 of the ship 1 extends approximately parallel to the plane of the sea/ocean (local water level). In this instance, the Plimsoll line 20 of the ship 1 coincides in FIG. 2 with the waterline 209.

Figure 3:
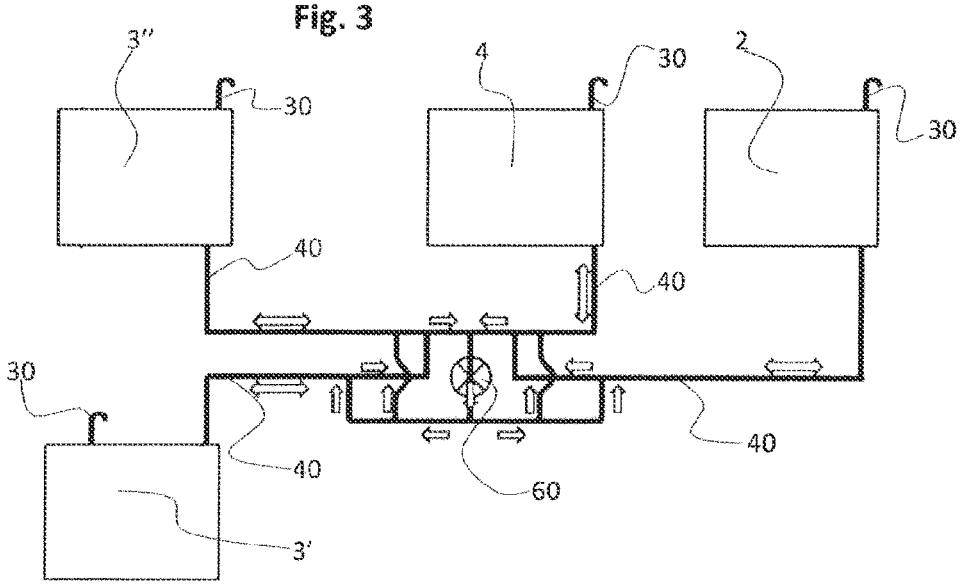
FIG. 3 illustrates a schematic of the functioning of the circuit for transferring liquid between the four tanks present in the tank in accordance with one embodiment of the invention.

FIG. 3 shows schematically an embodiment of the invention in which the ship has or includes four tanks, a bow tank 2, a midships tank 4 and two stern tanks 3', 3" offset relative to one another along the transverse axis y'y. This kind of embodiment, with these two laterally offset stern tanks 3', 3", is represented in a clearer manner in FIG. 4 in which only these two stern tanks 3', 3" are represented.

As can be seen in FIG. 3, each of the tanks 2, 3', 3" and 4 has at least one filling/emptying line 30 and one liquid transfer line 40. The filling/emptying line 30 enables filling or emptying of the tank concerned independently of the other tanks with which they communicate whereas the transfer line 40 enables the liquid to be transported from or to that tank, respectively at least partly to empty that tank and at least partly to fill another tank and at least partly to fill that tank and at least partly to empty another tank. Of course, the network of liquid transfer lines 40 interconnecting the various tanks as shown in FIG. 3 is merely one example of this kind of network and any arrangement or layout of these transfer lines 40 may be employed provided that this network addresses the objective of enabling or authorizing circulation of liquid between at least two tanks 2, 3', 3", 4. The network of liquid transfer lines 40 includes at least one pump 60, preferably a plurality of pumps 60 and possible as many thereof as there are tanks 2, 3", 3", 4, able at least partly to empty a tank 2, 3', 3" or 4 to transfer the liquid that it contains to another tank 2, 3', 3" or 4. Of course, a plurality of valves, remotely controlled like the pump 60, are provided in this liquid transfer line network 40 in order to send the liquid to the appropriate/desired tank.

The plurality of liquid tanks 2, 3', 3", 4 and the possibility of transferring liquid from at least one to another of those tanks 2, 3', 3", 4 are intended firstly to enable the inclination of the ship 1 or of the Plimsoll line 20 of the ship 1 to be varied so that the latter is conventionally parallel to the longitudinal axis x'x or to the plane in which the surface of the sea/ocean extends. A second objective of these tanks 2, 3', 3", 4 and of the possibility of transferring liquid between at least two tanks aims to lower the waterline of the ship 1 or to increase its draught but only to the minimum level required to authorize or to facilitate its maneuverability, thus in particular when a captain boards in order to direct the ship when it enters a particular port or port zone.

Figure 4:
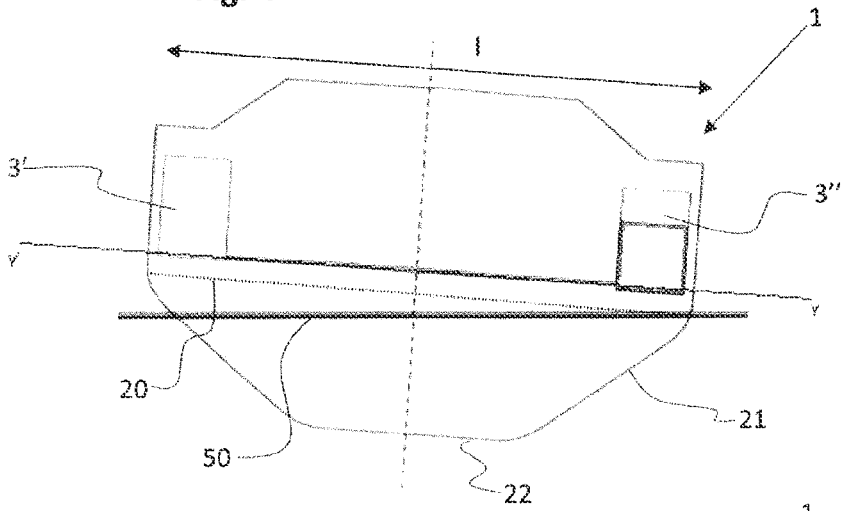
FIG. 4 is a view in cross section of a ship in accordance with one embodiment of the invention.

In the embodiment shown in FIG. 4 the ship 1 includes at least two tanks 3', 3" offset relative to one another along the transverse axis y'y. To be more precise, a first tank 3' is situated in the first third, preferably in the first quarter, along the width & of the ship, along the transverse axis y'y, and the second tank 3" is situated in the last third, preferably in the last quarter, again along the width & of the ship 1.

In this figure there has been shown the starboard tank 3" filled, to approximately two-thirds (⅔) of its maximum volume/mass capacity, whereas the port tank 3' is empty. Because of this weight difference or gradient, the ship 1 therefore lists to one side, in other words the Plimsoll line 20 of the ship 1, here extending parallel to the transverse axis y'y, has a (non-zero) inclination or angle relative to the plane of the surface of the sea/ocean 50 (local water level). This being so, transferring liquid between these two tanks 3', 3" results in the Plimsoll line 20 of the ship 1 here being flush with the level of the the sea/ocean 50 on the starboard side so that a shuttle or the like, not shown in the appended figures, can come to be positioned contiguously with the ship 1 to deliver a captain able to direct the ship for its approach to and its penetration into a difficult port or port zone, without that shuttle or the like risking being crushed or damaged by the flanks 21 of the hull of the ship 1 when the sea conditions are unpredictable. Indeed, thanks to the invention, the possible transfer of liquid from two tanks 3', 3" positioned offset or at a distance along a transverse axis y'y of the ship 1 (that is to say along its width) enable the ship to be caused to heel as required, in particular when a smaller boat comes alongside so as not to risk it being crushed/damaged by its inclined flanks 21 situated clearly above the level of the sea/ocean 50 (because of the absence of cargo/load on the ship 1).

FIGS. 5*a* and 5*b* show one of the design choices for the ship 1 in accordance with the invention that have led to its particular characteristics and dimensions. Thus when the ship 1 is in dry dock, in particular to undergo refurbishment and possibly repairs, it is imperative that there is no risk of it capsizing in a strong crosswind (along the transverse axis y'y), as shown in FIG. 5*b*. Indeed, because of the absence of seawater ballast, the ship 1 in accordance with the invention has a lower hull of trapezoidal shape, that is to say in particular a plane lower part 22 at the two ends of which respectively extend two inclined flanks 21. Given the length L and the height of the ship 1, the plane lower part 22 of the ship 1 is designed sufficiently wide for the ship 1 to be able to resist, given its unladen weight, a lateral crosswind exerting a maximum force (the value of which is determined by international standards or regulations). The width of the plane part 22 of the ship 1 in accordance with the invention is therefore a function of its length L, of its height and of its unladen weight so that said ship 1 is able to resist an extreme force (quantified by regulations for safe maintenance operations in dry dock) directed laterally, along the axis y'y or parallel to that axis, so that the ship 1 does not tilt when in dry dock, resting on the plane part 22 of its lower hull.

FIG. 6 shows a complementary aspect of the ship 1 in accordance with the invention. In this figure there has been represented in vertical section a half-hull of the ship 1 (of width ½). Here the design of a ship 1 in accordance with the invention with no seawater ballast aims firstly to ensure that, when the ship 1 is unladen (with no cargo/merchandise), the waterline 44 of the ship 1 is close to the Plimsoll line 20 of the ship 1, that is to say the zone from which the inclined flanks 21 extending from the lower hull terminate. The difference between the waterline 44 of the ship 1 unladen and the Plimsoll line 20 of the ship 1 must be at most equal to 1 meter, preferably less than 50 cm (centimeter), or even very preferably less than 30 cm. Note that, in this FIG. 6, there has also been represented a waterline 45 of the ship 1 when the latter is laden, that is to say when it is transporting cargo and/or merchandise. Moreover, the two flanks have an inclination by angle $\alpha$ between 10° and 45° inclusive, preferably between 15° and 35° inclusive.

These requirements for production of the V-shaped lower hull of the ship 1 with no seawater ballast concerning the low height h are provided in particular, but not exclusively, so as not to damage or break a small boat coming alongside the ship when the sea or the ocean is agitated.

FIG. 7 shows a functional schematic view in section of a ship including a mooring tank 12 as shown in FIG. 1. As explained hereinabove, this kind of mooring tank 12 is situated at the bow of the ship in order to balance the ship 1 and to enable it to have a horizontal trim, that is to say a Plimsoll line 20 parallel to the level of the water.

In this FIG. 7 the waterline of the ship when unladen, i.e. when transporting no load, is shown by the number 109 when the mooring tank 12 is empty and by the number 209 when it is filled. The mooring tank 12 is connected on the one hand to a supply line 13 and, on the other hand, to a drain line 14. The supply line discharges into the upper part of the mooring tank 12 in order to fill said mooring tank 12, for example by means of a pump (not shown) drawing up seawater from the port zone to fill the mooring tank 12. The drain line 14 is arranged in the bottom of the mooring tank 12 in order to enable emptying of the mooring tank 12. This drain line 14 discharges directly on a flank of the ship 1, for example above the Plimsoll line 20, in order to decant the content of the mooring tank 12 into the sea.

The invention claimed is:

1. A method for controlling a trim of a transport ship without seawater ballast, the ship having a length L along the longitudinal axis of the ship and a width l along a transverse axis of the ship and including a lower hull a cross section of which takes the form of a trapezium comprising a part forming a flat bottom of the ship from which respectively extend two flanks of identical inclination, said ship having an unladen weight $P_v$ between 20% and 60% inclusive of its total weight $P_T$, allowing for a given maximum load weight $P_{TC}$, according to the formula:

$$P_T=P_v+P_{TC}$$

said ship including at least one bow closed liquid tank and one stern closed liquid tank not communicating with the sea, the total weight $P_{RT}$ of which, when entirely filled with a liquid of specific gravity equal to 1, represents between 2% and 8% of said unladen weight Pv, said tanks being in communication via at least one line for the transfer of liquid from one to the other, and said tanks being positioned facing one another essentially along the longitudinal axis and at a distance d from one another, considering the respective geometric center of each of said tanks, at least equal to L/4: d>L/4, the method including the step of transferring liquid into the bow tank when the load of the ship has a weight less than PTc/10 to straighten the waterline of the ship, wherein the ship further includes a mooring tank, the mooring tank being independent of the bow tank and of the stern tank, the ship further including a line for supplying liquid to the mooring tank and a line for draining the mooring tank, said mooring tank being at the bow of the ship, the method further including the step of transferring the liquid in the mooring tank via the supply line in order to straighten further the waterline of the ship.

2. The method as claimed in claim 1 for controlling the trim of a ship, in which the step of transferring the liquid into the bow tank is carried out until the bow tank is filled.

3. The method as claimed in claim 1 for controlling the trim of a ship, characterized in that the bow tank is situated in the first bow third of the ship and the stern tank is situated in the last stern third of the ship.

4. A method for controlling a trim of a transport ship without seawater ballast, the ship having a length L along the longitudinal axis of the ship and a width l along a transverse axis of the ship and including a lower hull a cross section of which takes the form of a trapezium comprising a part forming a flat bottom of the ship from which respectively extend two flanks of identical inclination, said ship having an unladen weight $P_v$ between 20% and 60% inclusive of its total weight $P_T$, allowing for a given maximum load weight $P_{TC}$, according to the formula:

$$P_T=P_v+P_{TC}$$

said ship including at least one bow closed liquid tank and one stern closed liquid tank not communicating with the sea, the total weight $P_{RT}$ of which, when entirely filled with a liquid of specific gravity equal to 1, represents between 2% and 8% of said unladen weight Pv, said tanks being in communication via at least one line for the transfer of liquid from one to the other, and said tanks being positioned facing one another essentially along the longitudinal axis and at a distance d from one another, considering the respective geometric center of each of said tanks, at least equal to L/4: d>L/4, the method including the step of transferring liquid into the bow tank when the load of the ship has a weight less than PTc/10 to straighten the waterline of the ship, wherein the ship includes a third tank, situated in a zone between 40% and 60% inclusive of the length L of the ship.

* * * * *